US008672203B2

(12) United States Patent
Staudecker et al.

(10) Patent No.: US 8,672,203 B2
(45) Date of Patent: Mar. 18, 2014

(54) RUCKSACK WITH REAR VENTILATION ZONE

(75) Inventors: Iris Staudecker, Basel (CH); Sem Hediger, Kuessnacht am Rigi (CH); Pierre Dubois, Bern (CH)

(73) Assignee: Mammut Sports Group AG (CH)

( * ) Notice: Subject to any disclaimer, the term of this patent is extended or adjusted under 35 U.S.C. 154(b) by 460 days.

(21) Appl. No.: 12/784,957

(22) Filed: May 21, 2010

(65) Prior Publication Data

US 2011/0284608 A1 Nov. 24, 2011

(51) Int. Cl.
*A45F 3/08* (2006.01)

(52) U.S. Cl.
USPC ..... 224/631; 224/633; 224/636; 224/637

(58) Field of Classification Search
USPC ..... 224/631, 633, 634, 635, 636, 637
See application file for complete search history.

(56) References Cited

U.S. PATENT DOCUMENTS

| | | | | |
|---|---|---|---|---|
| 4,074,839 | A | 2/1978 | Wood et al. | |
| 4,660,751 | A | 4/1987 | von Dewitz | |
| 5,553,759 | A * | 9/1996 | McMaster et al. | 224/631 |
| 5,586,699 | A * | 12/1996 | Heisler et al. | 224/628 |
| 5,984,157 | A * | 11/1999 | Swetish | 224/631 |
| 6,098,859 | A * | 8/2000 | Bortner | 224/272 |
| 6,325,262 | B1 * | 12/2001 | Thompson | 224/628 |
| 7,350,682 | B2 * | 4/2008 | Meyer | 224/628 |
| 2008/0041906 | A1 * | 2/2008 | Rose et al. | 224/628 |
| 2010/0116861 | A1 * | 5/2010 | Burrowes | 224/633 |
| 2010/0155447 | A1 * | 6/2010 | Zheng et al. | 224/576 |

FOREIGN PATENT DOCUMENTS

| | | | |
|---|---|---|---|
| DE | 93 02 683.8 | | 7/1993 |
| DE | 43 20 525 | | 12/1994 |
| DE | 197 35 806 | | 2/1999 |
| EP | 0 158 154 | | 10/1985 |
| EP | 622036 | A2 * | 11/1994 |
| EP | 979625 | A1 * | 2/2000 |
| EP | 1 728 451 | | 12/2006 |
| FR | 2 700 252 | | 7/1994 |
| JP | 2002-191433 | | 7/2002 |
| JP | 2010046329 | A * | 3/2010 |
| WO | WO 9221265 | A1 * | 12/1992 |
| WO | 2007/118193 | | 10/2007 |

OTHER PUBLICATIONS

Austrian Search Report issued Jul. 21, 2009 in connection with corresponding to Austrian application No. 09-30125.

* cited by examiner

*Primary Examiner* — Justin Larson
(74) *Attorney, Agent, or Firm* — Ostrolenk Faber LLP

(57) ABSTRACT

The invention relates to a rucksack (1) with a horizontally and vertically rear-ventilated air conditioning zone (6). It is composed of a shoulder strap carrying system (2), a rear wall (3) with a stiffening frame (4), and a mesh (5) stretched across the rear wall and/or across the stiffening frame for creating the rear-ventilated air conditioning zone (6) between the rear wall (3) and the back of a rucksack wearer. By virtue of the stretched mesh (5), the rear wall (3) is kept away from the back of the wearer both in the hip region and in the shoulder region and allows both a horizontal and a vertical exchange of air. In a variable embodiment of the rucksack (1), the rucksack (1) can optionally be adapted to the body of the wearer by attaching the shoulder straps (2) in the shoulder-side region in a horizontally and vertically adjustable manner to a baseplate (15) attached to the mesh (5).

20 Claims, 4 Drawing Sheets

RUCKSACK WITH REAR VENTILATION ZONE

TECHNICAL FIELD

The present invention relates to a rucksack with a rear-ventilated air conditioning zone which allows both in the horizontal and in the vertical direction a largely free circulation of air between the back of the wearer and the rear wall of the rucksack facing toward the wearer.

PRIOR ART

Numerous rucksack models are known in the prior art which have devices for rear ventilation, by virtue of which the back of the rucksack wearer is continuously ventilated and can thus be kept as dry as possible despite physical exertion, for example when walking, hiking or climbing. One common feature of all these rucksacks is that the rear wall of the rucksack facing toward the rucksack wearer is pushed away from the back of the rucksack wearer by means of spacers in order to minimize the direct contact with the back. To this end, usually either individual pad elements arranged in a distributed manner are placed on the rear wall of the rucksack, such as e.g. in WO2007/118193, where the pad elements are even inflatable, or else a type of grid construction, such as e.g. in EP1728451, or a type of perforated panel construction, such as e.g. in FR2700252 is used. In such rucksack models, typically the rear wall of the rucksack is also at the same time stiffened by frame elements and brought into a desired shape.

Another variant of rear-ventilated rucksacks is characterized in that it has on the rucksack rear wall a concavely curved frame construction, over which there is stretched a mesh which bears against the back of the wearer and enforces a large free space between it and the rucksack rear wall. EP0158154 discloses for example such a hiking rucksack, the rear wall of which has a stiffening frame which is designed in the shape of an upright "A" and is concavely curved and thus concavely pretensions the rear wall of the rucksack. A mesh is stretched over this frame, which keeps the rucksack rear wall at a distance from the back of the wearer.

DE19735806 presents a further development of this concave frame system with a stretched mesh and additionally comprises pad elements, by means of which the mesh is kept at a distance from the back of the wearer.

One disadvantage of the rear-ventilated rucksack models known in the prior art is on the one hand the frequent lack of adaptability of the stretching or stiffening frame to the anatomy of the back of the rucksack wearer, and on the other hand the excessively complicated and elaborate design of the spacer or ventilation construction of some rucksack models. In addition, on most rucksacks it can be seen that they allow a transverse ventilation in the essentially horizontal direction, but do not allow any vertical ventilation in the direction in which the spinal column of the wearer runs, so that ultimately there is a build-up of heat and thus increased sweating in the back region of the wearer. Another disadvantage of concavely pretensioned rucksacks is also the poor load-bearing capacity thereof and also their unfavorable center of gravity away from the back when used as intended.

The aim of the present invention is therefore to avoid such disadvantages and to provide a rucksack having a simple, highly efficient, flexible, anatomically adapted or adaptable and nevertheless inexpensive rear ventilation system, which is moreover characterized by a high level of wearing comfort. This aim is achieved by a rucksack according to claim 1.

Further advantageous embodiments of the invention are defined in the dependent claims.

Where direction details are used below in connection with regions of the rucksack according to the invention, these always refer—unless another meaning is explicitly mentioned or is obvious from the context—to a rucksack in the upright position according to its orientation when used as intended by a user walking upright.

DESCRIPTION OF THE INVENTION

Figure 1:
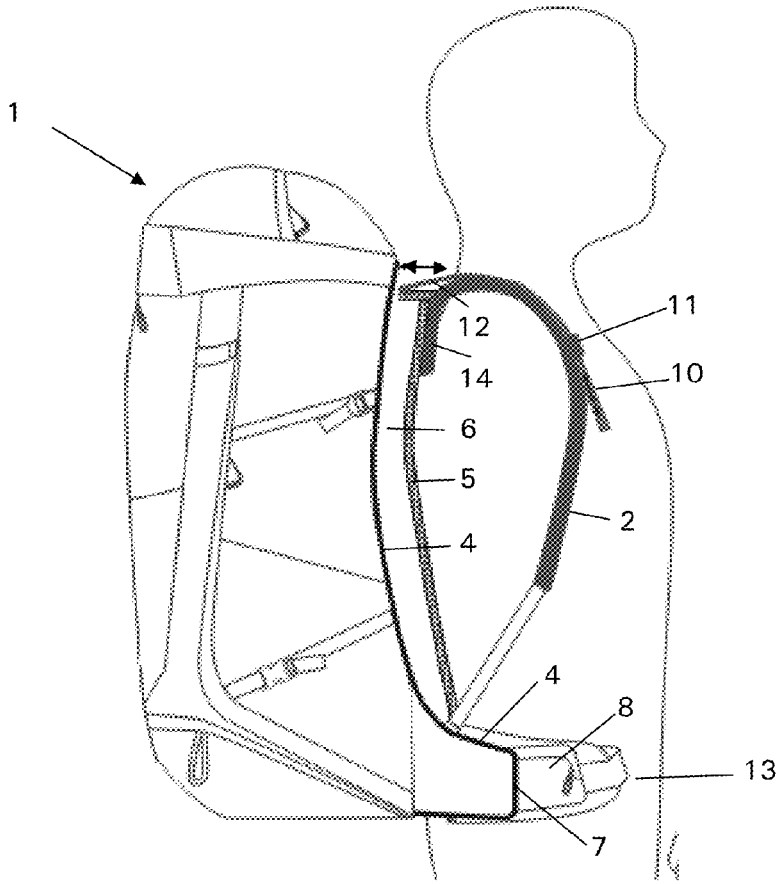
FIG. 1 shows a schematic diagram of a first embodiment of a rucksack according to the invention with variable spacing adjustment, in the upright position, in a side view.

In the illustrated embodiments, the invention relates to a rucksack 1 with shoulder straps 2, a rear wall 3 with a stiffening frame 4 integrated therein, and a mesh 5 arranged in the region of the rear wall for creating a rear-ventilated air conditioning zone 6 between the rear wall 3 and the back of a rucksack wearer, wherein the stiffening frame 4—as seen in the upright position of the rucksack—has two longitudinal sections which are oriented essentially parallel to one another, are arranged in side edge seams of the rear wall 3 and run in the vertical direction, which longitudinal sections protrude from the rear wall 3 at one of their ends, the hip-side end, and merge into corner sections 7 which are bent forward in the manner of a loop and point away from the rear wall 3, to which corner sections there are attached pad elements 8.

The mesh 5 is attached by its shoulder-side end directly to the rear wall 3 of the rucksack 1 and/or to sections of the stiffening frame 4 which run horizontally in the top region of the rucksack 1 and is attached by its hip-side end to said pad elements 8 and/or to sections of the stiffening frame 4 which run horizontally in the bottom region of the rucksack 1. The shoulder straps 2 are attached by their shoulder-side end to the mesh 5 at a preselected distance from the shoulder-side end thereof and are fixed by their hip-side end to the rear wall 3, to the stiffening frame 4 and/or to the mesh 5 in the region of the hip-side end thereof.

Figure 3:
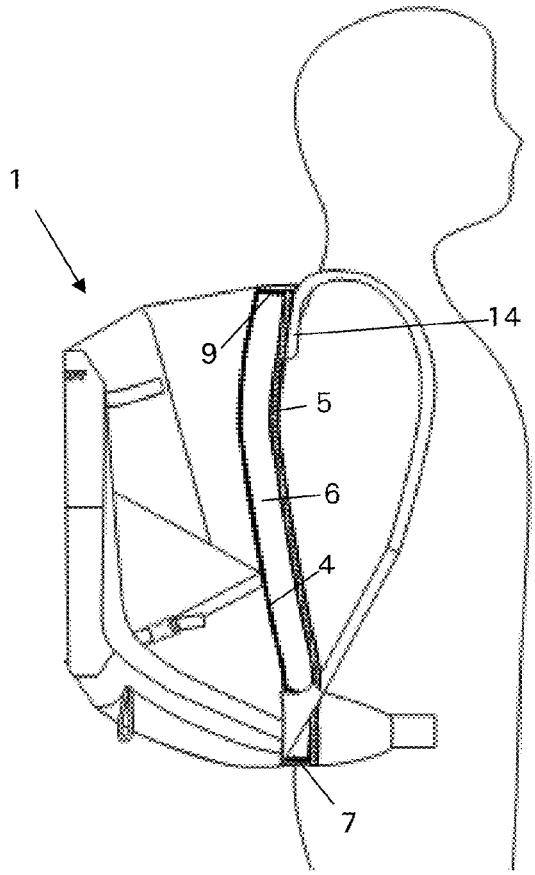
FIG. 3 shows a schematic diagram of a second embodiment of a rucksack according to the invention with corner sections of the stiffening frame protruding on the shoulder side, in the upright position, in a side view.
Figure 4:
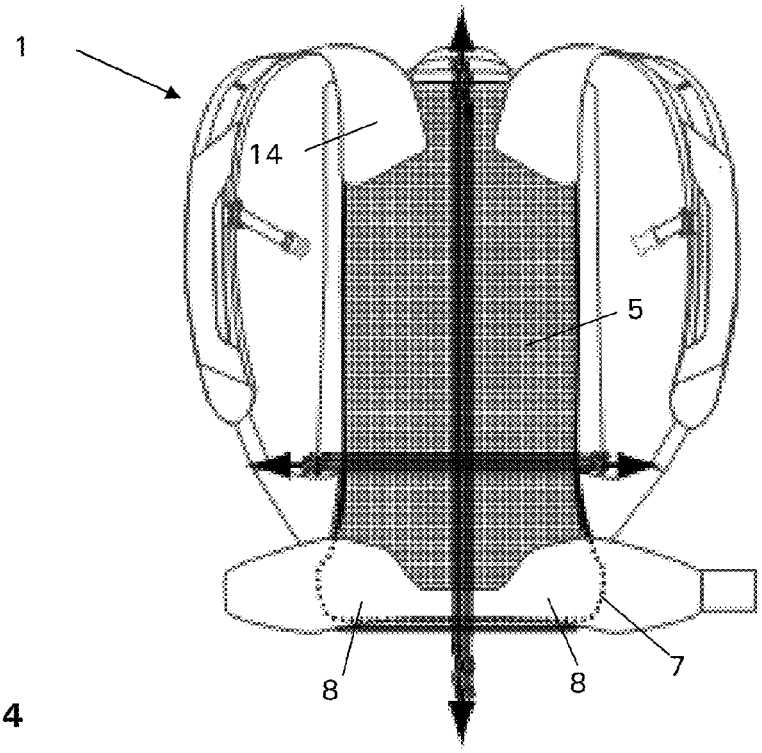
FIG. 4 shows the rear side of the rucksack of FIG. 3 facing toward the rucksack wearer, in a front view.

In an embodiment shown in FIGS. 3 and 4, the stiffening frame 4 may have at its shoulder-side end corner sections 9 and/or transverse sections which are bent forward, away from the rear wall 3, and on which the mesh 5 bears in the region of its shoulder-side end, as a result of which it is biased away from the rear wall 3 and the rear wall 3 is thus kept at a distance from the back of the wearer over its entire length.

In this way, when the rucksack 1 is used as intended, an air conditioning zone 6 is formed which runs between the mesh 5 and the rear wall 3, which air conditioning zone allows a circulation of air both in the horizontal and in the vertical direction and effectively prevents an undesirable build-up of heat.

Figure 2:
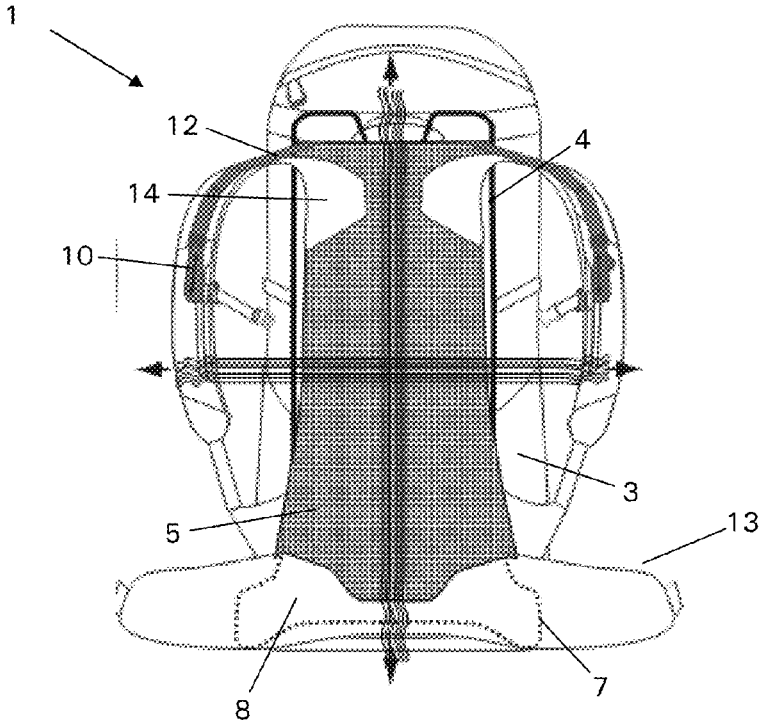
FIG. 2 shows the rear side of the rucksack of FIG. 1 facing toward the rucksack wearer, in a front view.

In the rucksack shown in FIGS. 1 and 2 without corner sections 9 of the stiffening frame 4 protruding on the shoulder side, the mesh 5 in the unused state of the rucksack 1 hangs down slackly or loosely on the rear wall 3. In order to achieve the effect of vertical ventilation according to the invention, the mesh 5—as seen in the upright position of the rucksack 1—a few centimeters, typically 3-10 cm, preferably 5-8 cm, below its shoulder-side end which is fixed directly to the rucksack 1, is additionally fixedly connected to the shoulder-side ends of the shoulder straps 2 which are anchored to the mesh 5. This means that the rear wall 3, when the rucksack 1 is used as intended, is pulled away from the mesh 5 by the weight of the rucksack 1 and the mesh 5 at the same time is stretched by the shoulder straps 2 fixed thereto. In collaboration with the protruding corner sections 7 of the hip-side end of the stiffening frame 4, in this embodiment too there is therefore formed a horizontally and vertically ventilated air conditioning zone 6, typically of approximately constant layer thickness, which runs between the mesh 5 and the rear wall 3 and is open in all directions. The distance produced at the shoulder side between the mesh 5 and the rear wall 3 in this case corresponds essentially to the distance between the shoulder-side fixing of the mesh 5, 5*a* to the rear wall 3 and the fixing of the shoulder-side ends of the shoulder straps 2 to the mesh 5.

For this purpose, the longitudinal sections of the stiffening frame 4 are advantageously ergonomically shaped and are curved in a slightly s-shaped manner to match the shape of the spinal column, as a result of which the distance between the mesh 5 and the rear wall 3 remains approximately constant over its entire profile and an air conditioning zone 6 of approximately constant layer thickness or depth is created.

The stiffening frame 4 itself is typically made from metal, for example from metal wire or metal tube, or from a comparably stable frame material made from plastic and is preferably a one-piece part which is optionally closed all the way round.

In the rucksack 1 shown in FIGS. 1 and 2 without corner sections 9 of the stiffening frame 4 protruding on the shoulder side, each shoulder strap 2 is equipped in the region of its shoulder-side end with an adjustable spacer which comprises a tightening strap 10 with a strap adjuster 11 and additionally an elongate, essentially shape-stable and optionally slightly curved and/or elastic spacer clip 12 which is anchored in a longitudinally displaceable manner in a pocket arranged on the shoulder strap 2. In this case, both the tightening strap 10 and the spacer clip 12 are fixed by one of their ends in each case in the top region of the rear wall 3 directly to the edge of the shoulder-side end of the mesh 5 or above the latter and are attached by their other end in each case to the shoulder strap 2.

By means of the tightening strap 10, the spacer clip 12 can be lowered into the guide pockets of the shoulder straps 2 and thus the rucksack 1 can be pulled more tightly against the body of the wearer and can be fixed in this position via the strap adjusters 11, wherein the spacer clip 12 slides within the guide pocket optionally as far as the end point thereof. As a result, the center of gravity of the rucksack 1 is brought closer to the body of the wearer and at the same time the rucksack 1 is prevented from swinging back and forth on the back of the wearer and placing the wearer in undesirable difficulties for example in a hazardous situation. However, this mechanism can also be used to intentionally reduce the rear ventilation and dissipation of heat in the back region, for example in order to keep the back of the rucksack wearer warm for example in cold weather, at the start of a walking tour or after a relatively long rest. By releasing the tightening strap 10, the previous state can be restored and the back can once again be optimally ventilated from the rear.

The abovementioned pad elements 8 attached to the stiffening frame 4 on the hip side are generally part of a pelvic strap system 13 which comprises a left and a right tightening strap, a tightening strap lock and pad elements attached laterally to the rear wall 3 or the hip-side corner sections 7 of the stiffening frame 4 and/or in the region of the hip-side end of the mesh 5 and fixedly connected to the tightening straps.

Another embodiment of the rucksack 1 is characterized in that the corner sections 7 of the stiffening frame 4 which protrude on the hip side engage in pockets provided for this purpose on the pad elements 8 of the pelvic strap system 13, are—optionally displaceably—mounted therein and support the latter in a shape-stable manner. The mesh 5 is preferably connected to the pad elements 8 in such a way that it covers the free region between the ends of the pad elements 8 fixed to the stiffening frame 4 and facing toward the rear wall 3 and connects said ends to one another in such a way that, during use of the rucksack 1, a sufficiently large, optionally elastic, mechanical stress is built up between these pad elements 8 and the mesh 5, which keeps the rear wall 3 away from the body of the wearer also in the hip-side region.

The stiffening frame 4 is also typically covered by pad elements 14 in the region of its corner sections 9 protruding on the shoulder side, wherein these pad elements 14 are normally provided by the shoulder-side ends of the shoulder straps 2, which are usually thickly padded.

Compared to most rucksack models known in the prior art, particularly those with only concavely curved stiffening frames, the embodiments of the stiffening frame 4 according to the invention have the advantage that, besides the horizontal exchange of air, a vertical exchange of air is also possible because the top part of the rucksack 1 is also kept away from the back of the wearer and the moist warm air can be drawn upward unhindered away from the back of the wearer via the resulting air gap. If the stiffening frame 4 is also curved in an S-shape to match the profile of the spinal column, a ventilation zone or air conditioning zone 6 which is curved in a slightly s-shaped manner and is of essentially constant thickness is formed over the entire rear wall region of the rucksack since the pretensioned mesh 5 is adapted to the shape of the back by the bearing pressure of the loaded rucksack 1 and the opposite rear wall 3 of the rucksack 1 is curved parallel thereto in the same manner.

By contrast, a purely concave pretensioning of the rear wall 3 generates a non-uniform, unnecessarily thick zone between the mesh 5 and the rucksack 1 which is rear-ventilated only horizontally. Furthermore, such concavely pretensioned types of rucksack can be loaded only poorly and move the center of gravity of the rucksack unfavorably away from the body of the wearer.

Figure 5:
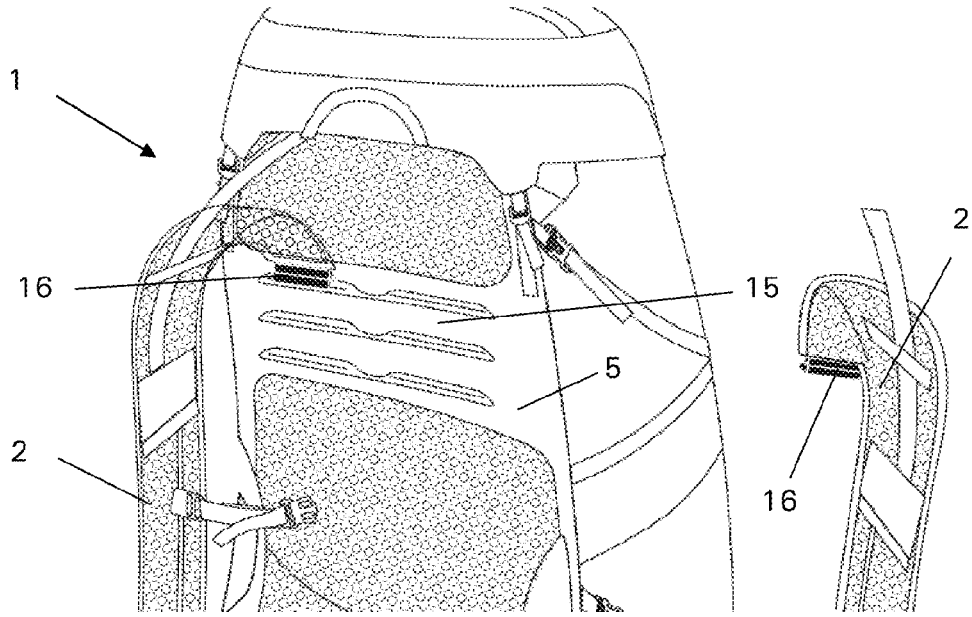
FIG. 5 shows the rear side of a third embodiment of a rucksack according to the invention facing toward the rucksack wearer, in a front view.
Figure 6:
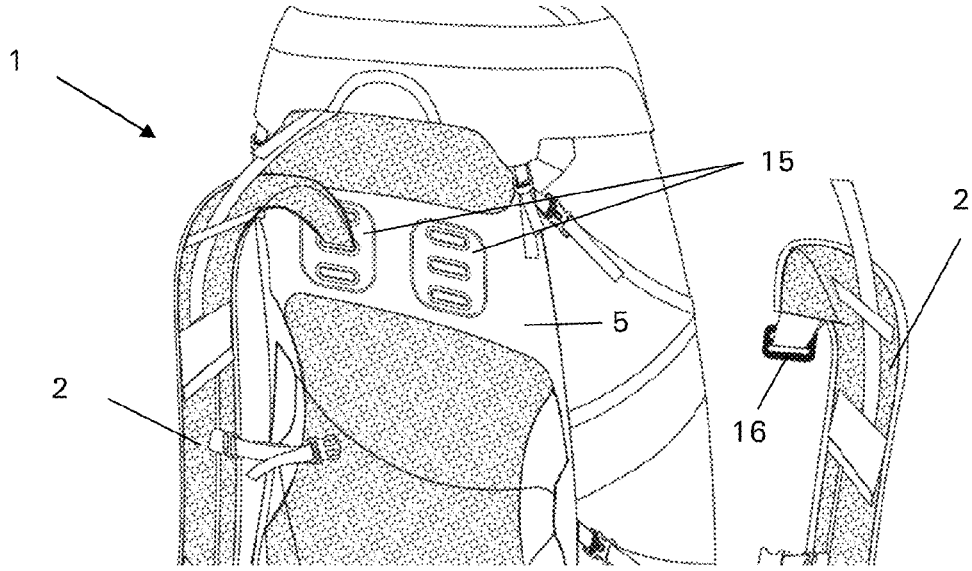
FIG. 6 shows the rear side of a fourth embodiment of a rucksack according to the invention facing toward the rucksack wearer, in a front view.
Figure 7:
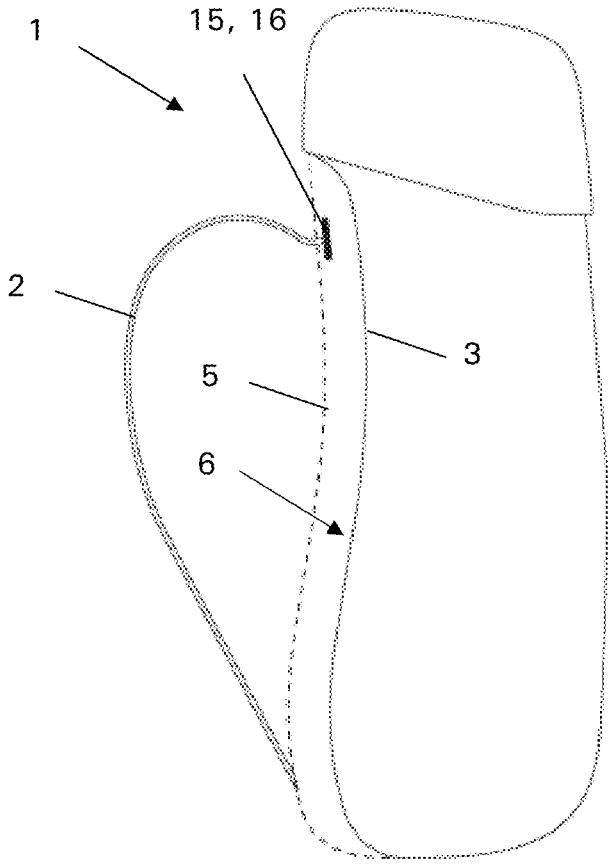
FIG. 7 shows a schematic diagram of the rucksacks of FIG. 5 or 6 with an adjustment plate in the mesh, in the upright position, in a side view.

In the rucksack 1 shown in FIGS. 5 to 7, the shoulder straps 2 can be adjusted individually in the horizontal and vertical direction to the anatomy of the back of the rucksack wearer via an adjustment system. On the one hand, the rucksack 1 is thus positioned as close to the back as possible, and on the other hand the load of the rucksack 1 is transferred as uniformly as possible to the shoulders of the wearer. The adjustment system comprises an adjustment plate 15 and adjustment elements 16. The adjustment plate 15 is attached to the mesh 5. The adjustment plate 15 is attached to the side of the mesh 5 facing away from the rear wall 3, so that it is easily accessible to the wearer of the rucksack 1. The adjustment plate 15 may be made from metal and/or plastic and may be connected to the mesh 5 in a mechanically durable manner via a form fit and/or a material fit. In each case one adjustment element 16 is attached to a shoulder-side end of the shoulder straps 2. The adjustment elements 16 are made from metal and/or plastic. The adjustment elements 16 are attached to the adjustment plate 15 in a horizontally and vertically adjustable manner. The adjustment elements 16 are reversibly attached by the wearer of the rucksack 1. In the embodiment shown in FIG. 5, the adjustment element 16 is a clamp and the adjustment plate 15 is a baseplate comprising a plurality of rods, preferably a matrix of two by three sewn-in rods. In order to adjustably attach the clamp, the clamp is opened by hand, pushed over one of the rods and fixed in this fixing position by releasing the clamp. In the embodiment shown in FIG. 6, the adjustment element 16 is a strap adjuster, preferably a three-bar strap adjuster, and the adjustment plate 15 is a baseplate comprising a plurality of slots, preferably a matrix of two by three slots. The shoulder-side end of the shoulder strap 2 is attached to the middle bar of the three-bar strap adjuster. In order to adjustably attach the three-bar strap adjuster, the three-bar strap adjuster is pushed by hand into a slot and is rotated into a fixing position, so that the two outer bars of the three-bar strap adjuster come to lie behind the edge of the slot. As shown in FIGS. 5 and 6, the wearer can select for each adjustment element 16 of the two shoulder straps 2 three different fixing positions arranged at a vertical distance from one another on the adjustment plate 15, namely one of three bars or slots arranged one above the other. Since the bars and slots are longer than the adjustment element 16, the wearer can displace the adjustment element 16 along the selected bar or slot in the horizontal direction and thus can also select in the horizontal direction one of a plurality of fixing positions. By way of example, the bars or slots of the adjustment plate 15 are at a distance of two or three centimeters from one another in the vertical direction and an adjustment element 16 can be displaced by one or two centimeters in the horizontal direction along a bar or in a slot. One particular advantage of attaching the adjustment plate 15 to the mesh 5 is the fact that the adjustment plate 15, when the rucksack 1 is used as intended, is loaded only in tension, which additionally stabilizes the air conditioning zone 6 by the load of the rucksack 1. To this end, FIG. 7 schematically shows how the load of the rucksack 1 is transferred from the top region of the rucksack 1 into the shoulder-side end of the mesh 5 and from there into the adjustment plate 15 and from the adjustment plate 15 via the adjustment element 16 into the shoulder straps 2 and from there into the body of the wearer of the rucksack 1. The mechanical stress in the mesh 5 which is formed as a result stabilizes the air conditioning zone 6 and keeps the rear wall 3 of the rucksack 1 away from the body of the wearer.

| List of references | |
|---|---|
| 1 | rucksack |
| 2 | shoulder straps |
| 3 | rear wall |
| 4 | stiffening frame |
| 5 | mesh |
| 6 | air conditioning zone |
| 7 | corner section of the stiffening frame protruding on the hip side |
| 8 | hip-side pad elements, optionally as part of a pelvic strap system |
| 9 | corner section of the stiffening frame protruding on the shoulder side |

-continued

| List of references | |
|---|---|
| 10 | tightening strap |
| 11 | strap adjuster |
| 12 | spacer clip |
| 13 | pelvic strap system |
| 14 | shoulder-side pad elements, e.g. strap ends |
| 15 | adjustment plate |
| 16 | adjustment element |

The invention claimed is:

1. A rucksack comprising shoulder straps, a rear wall with a stiffening frame integrated therein, and a mesh panel arranged in the region of the rear wall for creating a rear-ventilated air conditioning zone between the rear wall and the mesh panel, characterized in that an adjustment plate is attached to the mesh panel, in that an adjustment element is attached to each shoulder-side end of the shoulder straps, and in that the adjustment elements are attached to the adjustment plate such that they can be adjusted in the horizontal and vertical direction.

2. The rucksack according to claim 1, characterized in that the adjustment element is a clamp, in that the adjustment plate is a baseplate comprising a plurality of horizontally oriented rods arranged vertically one above the other, and in that the clamp in the open state can be pushed over one of the rods and by releasing the clamp can be fixed in a fixing position which is adjustable in the horizontal and vertical direction.

3. The rucksack according to claim 1, characterized in that the adjustment element is a strap adjuster, in that the adjustment plate is a baseplate comprising a plurality of slots, and in that the strap adjuster can be pushed into one of the slots and by rotation can be fixed behind the slot in a fixing position which is adjustable in the horizontal and vertical direction.

4. A rucksack comprising shoulder straps, a rear wall with a stiffening frame integrated therein, and a mesh panel arranged in the region of the rear wall for creating a rear-ventilated air conditioning zone between the rear wall and the mesh panel, wherein the stiffening frame—as seen in the upright position of the rucksack—has two longitudinal sections which are oriented essentially parallel to one another, are arranged in side edge seams of the rear wall and run in the vertical direction, which longitudinal sections protrude from the rear wall at one of their ends, the hip-side end, and merge into corner sections which are bent forward in the manner of a loop and point away from the rear wall, to which corner sections there are attached pad elements, characterized in that a) the mesh panel is attached by a shoulder-side end thereof directly to at least one of said rear wall of the rucksack and said sections of the stiffening frame which run horizontally in the top region of the rucksack, the mesh panel being attached by a hip-side end thereof to at least one of said pad elements and said sections of the stiffening frame which run horizontally in the bottom region of the rucksack;

b) the shoulder straps are attached by shoulder-side ends thereof to the mesh panel at a preselected distance from the shoulder-side end of the mesh panel and are fixed by hip-side ends thereof to at least one of the rear wall, the stiffening frame and the mesh panel in the region of the hip-side end thereof;

wherein, when the rucksack is used as intended, a rear-ventilated air conditioning zone is formed which runs between the mesh panel and the rear wall and is open in the horizontal and vertical direction.

5. The rucksack according to claim 4, characterized in that the stiffening frame is made from metal wire, metal tube or a comparable frame material made from plastic.

6. The rucksack according to claim 4, characterized in that the stiffening frame has at its shoulder-side end at least one of corner sections and transverse sections which are bent forward, away from the rear wall, and on which the mesh panel bears in the region of its shoulder-side end, as a result of which it is biased away from the rear wall.

7. The rucksack according to claim 6, characterized in that the stiffening frame is covered by pad elements in the region of its corner sections which protrude on the shoulder side, wherein these pad elements are provided by the shoulder-side ends of padded shoulder straps.

8. The rucksack according to claim 4, characterized in that the longitudinal sections of the stiffening frame are ergonomically shaped and are curved in a slightly s-shaped manner to match the shape of the spinal column, as a result of which the distance between the mesh panel and the rear wall remains approximately constant over its entire profile and a rear-ventilated air conditioning zone of approximately constant depth is created.

9. The rucksack according to claim 8, characterized in that an adjustment plate is attached to the mesh panel, in that an adjustment element is attached to each shoulder-side end of the shoulder straps, and in that the adjustment elements are attached to the adjustment plate such that they can be adjusted in the horizontal and vertical direction.

10. The rucksack according to claim 9, characterized in that the adjustment element is a clamp, in that the adjustment plate is a baseplate comprising a plurality of horizontally oriented rods arranged vertically one above the other, and in that the clamp in the open state can be pushed over one of the rods and by releasing the clamp can be fixed in a fixing position which is adjustable in the horizontal and vertical direction.

11. The rucksack according to claim 9, characterized in that the adjustment element is a strap adjuster, in that the adjustment plate is a baseplate comprising a plurality of slots, and in that the strap adjuster can be pushed into one of the slots and by rotation can be fixed behind the slot in a fixing position which is adjustable in the horizontal and vertical direction.

12. The rucksack according to claim 4, characterized in that each shoulder strap is equipped in the region of its shoulder-side end with an adjustable spacer which comprises a tightening strap with a strap adjuster and additionally an elongate, essentially shape-stable spacer clip which is anchored in a longitudinally displaceable manner in a pocket arranged on the shoulder strap, wherein both the tightening strap and the spacer clip are fixed by one of their ends in the top region of the rear wall directly to the edge of the shoulder-side end of the mesh panel or above the mesh panel and are attached by their other end to the shoulder strap.

13. The rucksack according to claim 12, characterized in that it can be pulled toward the back of the wearer at its shoulder-side end via the tightening strap and can be fixed in this position via the strap adjuster.

14. The rucksack according to claim 12, wherein said spacer clip is either slightly curved or elastic, or both slightly curved and elastic.

15. The rucksack according to claim 4, characterized in that an adjustment plate is attached to the mesh panel, in that an adjustment element is attached to each shoulder-side end of the shoulder straps, and in that the adjustment elements are attached to the adjustment plate such that they can be adjusted in the horizontal and vertical direction.

16. The rucksack according to claim 15, characterized in that the adjustment element is a clamp, in that the adjustment plate is a baseplate comprising a plurality of horizontally oriented rods arranged vertically one above the other, and in that the clamp in the open state can be pushed over one of the rods and by releasing the clamp can be fixed in a fixing position which is adjustable in the horizontal and vertical direction.

17. The rucksack according to claim 15, characterized in that the adjustment element is a strap adjuster, in that the adjustment plate is a baseplate comprising a plurality of slots, and in that the strap adjuster can be pushed into one of the slots and by rotation can be fixed behind the slot in a fixing position which is adjustable in the horizontal and vertical direction.

18. The rucksack according to claim 4, characterized in that said pad elements are part of a pelvic strap system which comprises a left and a right tightening strap, a tightening strap lock and pad elements attached laterally to the rear wall or the hip-side corner sections of the stiffening frame and/or in the region of the hip-side end of the mesh and fixedly connected to the tightening straps.

19. The rucksack according to claim 18, characterized in that the corner sections of the stiffening frame which protrude on the hip side engage in pockets provided for this purpose on the pad elements of the pelvic strap system and are mounted therein.

20. The rucksack according to claim 19, wherein the corner sections of the stiffening frame are displaceably mounted in said pockets.

* * * * *